US005141409A

United States Patent [19]

Hirosawa et al.

[11] Patent Number: 5,141,409

[45] Date of Patent: Aug. 25, 1992

[54] COMPRESSION MACHINE

[75] Inventors: Koichiro Hirosawa; Hiroshi Kubo, both of Aichi, Japan

[73] Assignee: Aisin Seiki Kabushiki Kaisha, Kariya City, Japan

[21] Appl. No.: 666,638

[22] Filed: Mar. 8, 1991

[30] Foreign Application Priority Data

Mar. 29, 1990 [JP] Japan ..... 2-78876

[51] Int. Cl.[5] ..... F04B 45/04

[52] U.S. Cl. ..... 417/413; 92/99

[58] Field of Search ..... 417/413; 92/99

[56] References Cited

U.S. PATENT DOCUMENTS

| | | | |
|---|---|---|---|
| 862,867 | 8/1907 | Eggleston | 417/390 |
| 2,221,071 | 11/1940 | Barfud | 417/402 X |
| 3,814,548 | 6/1974 | Rupp | 417/395 |
| 4,049,366 | 9/1977 | Becker | 417/569 |

*Primary Examiner*—Leonard E. Smith

*Attorney, Agent, or Firm*—Oblon, Spivak, McClelland, Maier & Neustadt

[57] ABSTRACT

There is disclosed a durable compression machine that can be used as a compressor, pump, or actuator. The machine comprises a casing in which a flexible membrane is accommodated. The inside of the casing is partitioned into a compression chamber and a back pressure chamber by the membrane consisting of a diaphragm spring or bellows. The membrane is reciprocated to compress the fluid inside the compression chamber and to force the fluid out of the compression chamber. The back pressure chamber is sealed with a gas under pressure. The pressure inside the back pressure chamber acts in opposition to the pressure inside the compression chamber and is maintained at about half of the pressure obtained in the compression chamber during compression to suppress the flexure of the membrane.

3 Claims, 3 Drawing Sheets

COMPRESSION MACHINE

FIELD OF THE INVENTION

The present invention relates to a machine which compresses or conveys fluid and can be used as a compressor, pump, or actuator.

BACKGROUND OF THE INVENTION

A known machine compresses or conveys fluid by making use of changes in the volume of a compression chamber formed by a flexible membrane and the inner wall of a casing, the changes being brought about by reciprocation of the membrane. This membrane consists of a diaphragm or bellows mounted in the casing. A diaphragm type pump in which a diaphragm is used as the flexible membrane is disclosed in Japanese Patent Laid-Open No. 246569/1988.

Stress produced in a diaphragm or bellows is caused either by displacement or by pressure. The difference between the pressures inside and outside the compression chamber increases as the applied pressure increases. Since the diaphragm is subjected to great pressure differences, the diaphragm bends greatly, and the stress increases. This deteriorates the durability of the diaphragm. Also, the capability to compress fluid is impaired by the flexure. Furthermore, the rate of flow decreases. For these reasons, it has been heretofore impossible to use diaphragm type or bellows type compressors in high-pressure applications.

SUMMARY OF THE INVENTION

It is an object of the invention to provide a novel compression machine which is free of the foregoing problems.

The above object is achieved by a compression machine for compressing fluid utilizing changes in the volume of a compression chamber caused by reciprocation of a flexible membrane, the compression machine comprising: a casing; the flexible membrane accommodated in the casing and consisting of a diaphragm or bellows; the compression chamber formed by the flexible membrane and the inner wall of the casing; and a back pressure chamber partitioned from the compression chamber by the flexible membrane in the casing, the pressure inside the back pressure chamber being about half of the pressure produced inside the compression chamber during compression.

When the compression machine constructed as described above is compressing the fluid, the difference between the pressures inside and outside the compression chamber is reduced greatly, because the pressure inside the back pressure chamber acts in opposition to the pressure inside the compression chamber. Hence, the flexure is suppressed.

Other objects and features of the present invention will appear in the course of the description thereof which follows.

DETAILED DESCRIPTION OF THE INVENTION

Figure 1:
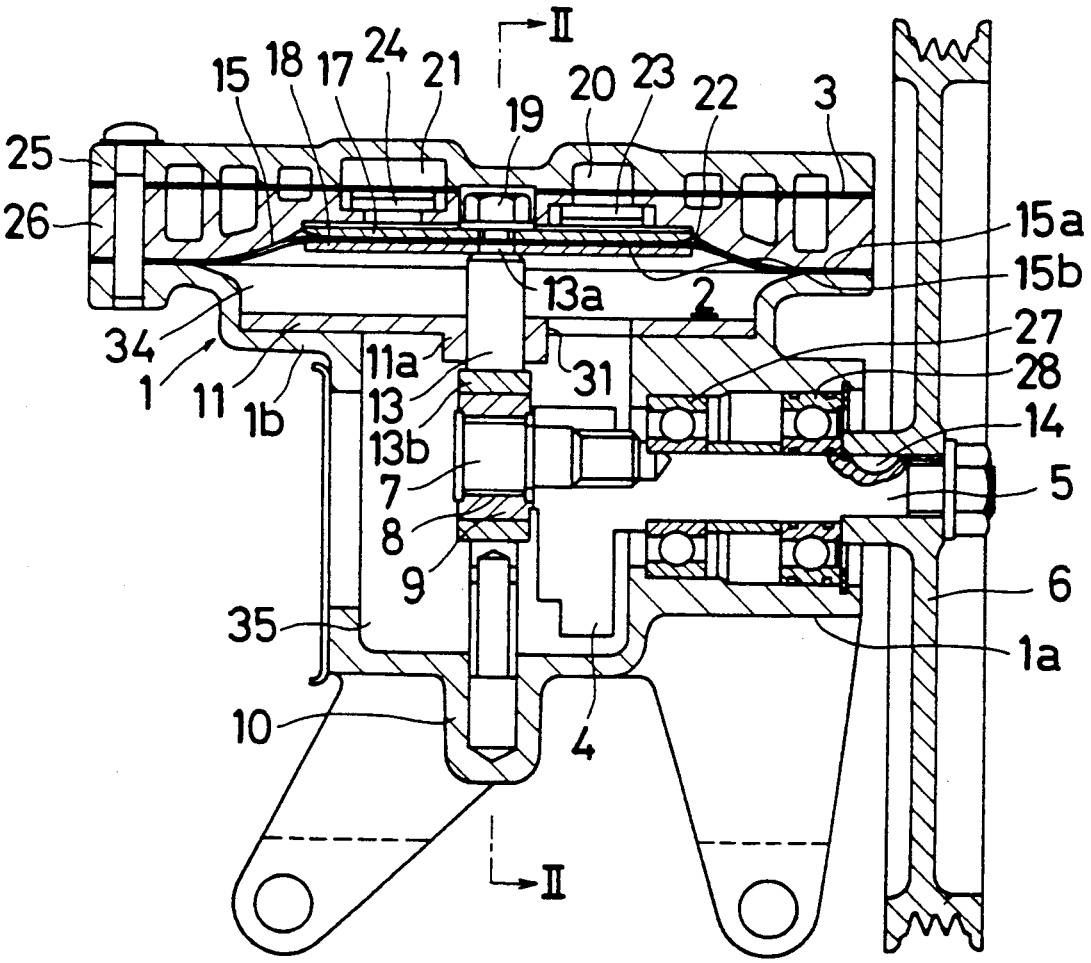
FIG. 1 is a vertical cross section of a diaphragm type compression machine according to the invention.

Referring to FIG. 1, there is shown a diaphragm type compression machine according to the invention. This machine includes a case, generally indicated by reference numeral 1. The case 1 and a valve case 26 together form a casing 2. A flexible membrane, or diaphragm 15, is accommodated in the casing 2. The diaphragm 15 has a fringe portion 15*a* and a central portion 15*b*. The fringe portion 15*a* is held between the cases 1 and 26, while the central portion 15*b* is held between two supports 17 and 18. The diaphragm 15 and the valve case 26 together form a chamber 22. An upper case 25 is attached via a gasket 3 to the surface of the valve case 26 that is on the opposite side of the chamber 22.

Figure 2:
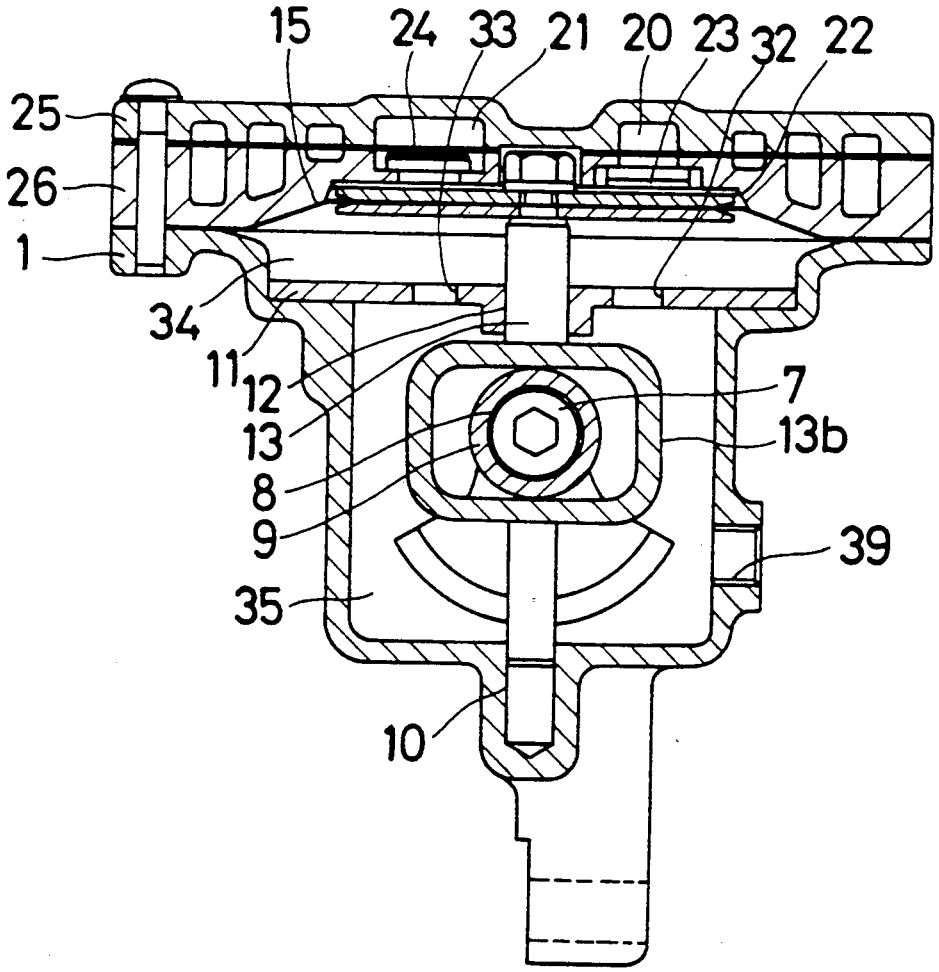
FIG. 2 is a cross-sectional view taken on the line II—II of FIG. 1.

A rod 13 extends through the supports 17 and 18 which are fixed to the front end 13*a* of the rod by a nut 19. As shown in FIG. 2, the rod 13 is centrally provided with a substantially oblong window 13*b*. An annular roller 9 slides in the window 13*b*. A shaft 7 fits in the roller 9 via a bearing 8 and mounted to an input shaft 5 eccentrically to it. When the input shaft 5 turns, the axis of the shaft 7 rotates around the central axis of the input shaft 5. A weight 4 is formed at the front end of the shaft 5 to maintain stable rotation in spite of unbalanced centrifugal force arising from the rotation of the shaft 7.

The case 1 has a step portion 1*b* on which the boss 11*a* of the support 11 is mounted. The rod 13 is held by the boss 11*a* and the wall defining a hole 10 formed in the case 1 such that the rod 13 can slide up and down as viewed in the figures.

The input shaft 5 is held to the boss 1*a* of the case 1 via bearings 27 and 28. A Woodruff key 14 is fixed to the rear end of the boss 1*a* to lock a pulley 6 against rotary movement.

An intake port 20 and a discharge port 21 are formed in both valve case 26 and upper case 25. Reed valves 23 and 24 are mounted in the ports 20 and 21, respectively. These ports are connected and disconnected with the chamber 22 by the reed valves 23 and 24, respectively.

A back pressure chamber is partitioned into an upper back pressure chamber 34 and a crank chamber 35 by the support 11. These chambers 34 and 35 are placed in communication with each other by holes 31, 32, and 33 formed in the support 11. The back pressure chamber is partitioned from the chamber 22 by the diaphragm 15. The case 1 forms the inner wall of the back pressure chamber. A gas under pressure is admitted into the back pressure chamber through an inlet port 39. The pressure inside the back pressure chamber is maintained at about half of the pressure P produced inside the chamber 22 during compression, i.e., about $P/2 \pm 10\%$. The back pressure chamber may be sealed with the gas.

In the operation of the compression machine constructed as described thus far, the power transmitted to the pulley 6 from a driving machine (not shown) rotates the input shaft 5, thereby rotating the shaft 7 around the axis of the input shaft 5. This causes the roller 9 to slide upward and downward via the bearing 8. At this time, the roller 9 itself slides horizontally in the window 13*b*.

The vertical movement of the roller 9 drives the rod 13 upward or downward. The movement of the rod 13 is transmitted via the supports 17 and 18 to the diaphragm 15, which is moved upward or downward. Then, the volume of the chamber 22 is varied to repeat suction and discharge of the fluid through the ports.

During the suction stroke, downward movement of the diaphragm 15 increases the volume of the chamber 22 to open the reed valve 23 in the intake port 20, thus permitting the fluid to flow into the chamber 22. During this process, the reed valve 24 on the discharge side is kept closed by the difference between the pressure in the discharge port 21 and the pressure in the chamber 22.

During the discharge stroke, upward movement of the diaphragm 15 reduces the volume of the chamber 22. The fluid in the chamber opens the reed valve 24 and flows out through the discharge port 21. During this process, the reed valve 23 is kept closed.

During either process, the pressure inside the chamber 22 increases, but the difference between the pressures inside and outside the chamber 22 is reduced greatly, because the pressure inside the upper back pressure chamber 34 and the pressure inside the crank chamber 25 act in opposition to the increased pressure inside the chamber 22. As a result, the flexure of the diaphragm due to the pressure difference is suppressed.

That is since, the pressure differential across the diaphragm 15 is only about half of what it would have been if the back pressure chamber were not present, diaphragm distortion is reduced by half. During the suction stroke a positive pressure is applied in the back pressure chamber, as compared to the chamber 22. This pressure is only about half the maximum compression pressure, and so the distortion of the diaphragm 15 during the suction step is about equal to, but opposite, that during compression.

Figure 3:
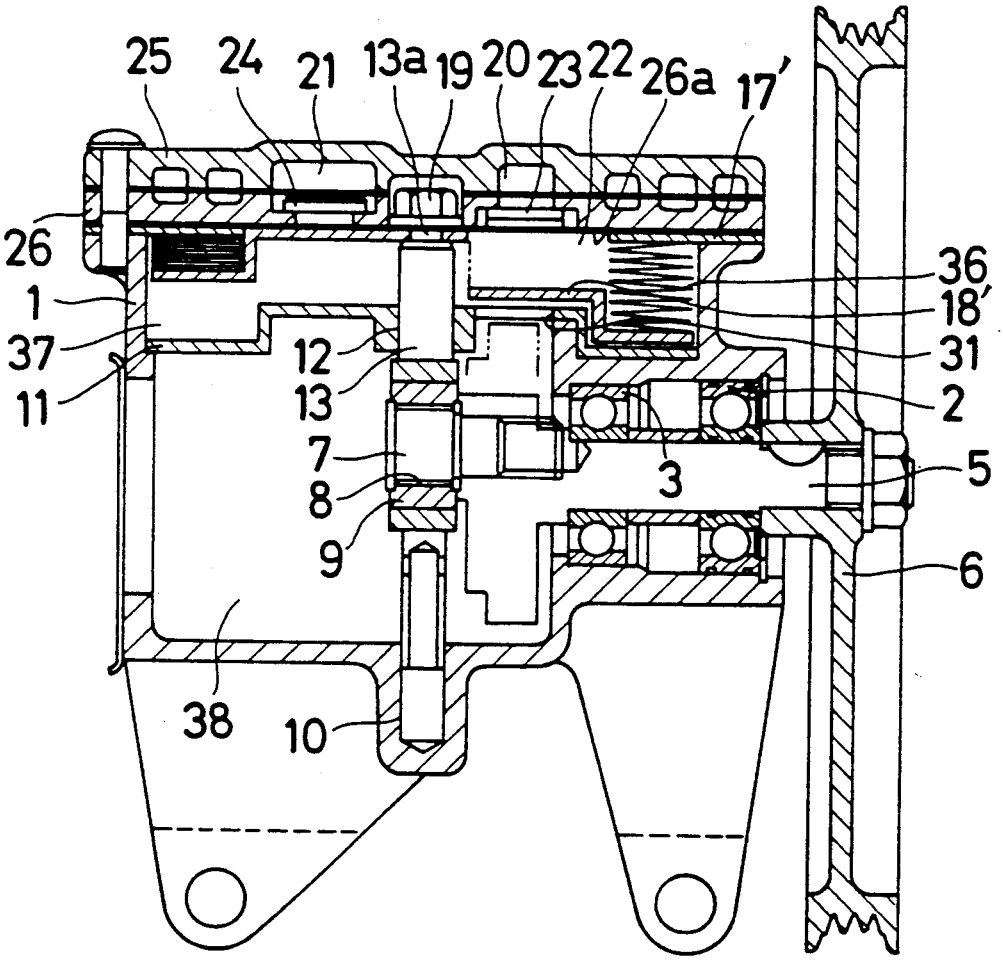
FIG. 3 is a vertical cross section of a bellows type compression machine according to the invention.

FIG. 3 is a vertical cross section of a bellows type compression machine having a back pressure chamber, the machine being built in accordance with the invention. It is to be noted that like components are indicated by like reference numerals in various figures.

The compression machine shown in FIG. 3 uses a bellows 36 as a flexible membrane. The bellows 36 is held between an annular support 17' and a disklike support 18' which protrudes inwardly at its center. The bellows 36 cooperates with the inner wall of the casing, or the inner wall **26*a* of a valve case 26, to form a chamber 22**.

The support 17' is mounted between the valve case 26 and a case 1. The support 18' is mounted to the front end **13*a* of a rod 13 by a nut 19. As the rod 13 moves up and down, the bellows 36 expands and contracts, thus changing the volume of the chamber 22**.

The back pressure chamber is partitioned into an upper back pressure chamber 37 and a crank chamber 38 by a support 11. These chambers are placed in communication with each other by holes 31, 32, and 33 formed in the support 11. The back pressure chamber is partitioned from the chamber 22 by the bellows 36 and the support 18'. The inner wall of the back pressure chamber is formed by the case 1. The inside of the back pressure chamber is retained at about half of the pressure obtained in the chamber 22 during the compression stroke by the gas under pressure. This reduces the difference between the pressures inside and outside the chamber 22 during the compression stroke. Hence, the flexure of the bellows 36 is suppressed.

As described thus far, in the novel compression machine, the difference between the pressures inside and outside the chamber formed by both flexible membrane and inner wall of the casing is reduced greatly because of the structure of the back pressure chamber. Thus, the flexure of the flexible membrane is suppressed. The durability of the flexible membrane is enhanced. Consequently, the capability of the compression machine to compress and deliver the fluid is higher than the prior art machine.

What is claimed is:

1. A compression machine comprising:

a flexible member accommodated in a casing;

a compression chamber formed by the membrane and an inner wall of the casing;

a compression means which reciprocates the membrane by a driving means to compress the fluid inside the compression chamber and to force the fluid out of the chamber according to changes in the volume of the chamber; and a biasing means which is partitioned from the compression chamber by the membrane and biases the membrane against the pressure inside the compression chamber, wherein said biasing means is a back pressure chamber sealed with a gas under pressure, and wherein the pressure inside the back pressure chamber is maintained at about half of the pressure obtained inside the compression chamber during compression.

2. The compression machine of claim 1, wherein said flexible membrane consists of a diaphragm spring.

3. The compression machine of claim 1, wherein said flexible membrane consists of a bellows.

* * * * *